US006692243B1

(12) United States Patent
Rousseau

(10) Patent No.: US 6,692,243 B1
(45) Date of Patent: Feb. 17, 2004

(54) SCREW COMPRESSION FLOW GUIDE FOR DISCHARGE LOSS REDUCTION

(75) Inventor: William H. Rousseau, Savannah, GA (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/231,403

(22) Filed: Aug. 27, 2002

(51) Int. Cl.[7] ..... F01C 1/24
(52) U.S. Cl. ..... 418/201.1; 418/201.3
(58) Field of Search ..... 418/201.1, 201.3

(56) References Cited

U.S. PATENT DOCUMENTS 2,457,314 A * 12/1948 Lysholm ..... 418/201.1
2,804,260 A * 8/1957 Nilsson et al. ..... 418/201.1
4,548,562 A * 10/1985 Hughson ..... 418/189
4,923,374 A * 5/1990 Lundin et al. ..... 417/440

FOREIGN PATENT DOCUMENTS

EP 372480 A2 * 6/1990 ..... F04C/18/16
WO WO 84/01004 A1 * 3/1984 ..... 418/201.1

* cited by examiner

*Primary Examiner*—Thomas Denion
*Assistant Examiner*—Theresa Trieu

(57) ABSTRACT

A screw compressor includes a housing having a discharge port; and at least two rotors disposed in the housing for generating opposed discharge flows through the discharge port, wherein the discharge port has edges defining a discharge opening, and wherein the edges are rounded so as to smooth flow of the discharge flows past the edges.

2 Claims, 2 Drawing Sheets

SCREW COMPRESSION FLOW GUIDE FOR DISCHARGE LOSS REDUCTION

BACKGROUND OF THE INVENTION

The invention relates to screw compressors and, more particularly, to reduction in losses at the discharge porting of a screw compressor.

As screw compressor speeds increase, kinetic pressure losses increase at the compressor discharge ports. Flow at the discharge port is characterized by converging streams that produce a highly contrasted flow cross-section downstream of the discharge. This results in high losses and/or the need for potentially bulky diffusers.

It is clear that the need remains for improvement in structures so as to reduce losses at this portion of the compressor.

It is therefore the primary object of the present invention to provide a compressor wherein losses at the discharge port are reduced.

Other objects and advantages of the present invention will appear hereinbelow.

SUMMARY OF THE INVENTION

In accordance with the present invention, the foregoing objects and advantages have been readily achieved.

According to the invention, a screw compressor is provided which comprises a housing having a discharge port; and at least two rotors disposed in said housing for generating opposed discharge flows through said discharge port, wherein said discharge port has edges defining a discharge opening, and wherein said edges are rounded so as to smooth flow-of said discharge flows past said edges.

BRIEF DESCRIPTION OF THE DRAWINGS

A detailed description of preferred embodiments of the present invention follows, with reference to the attached drawings, wherein.

DETAILED DESCRIPTION

The invention relates to a screw compressor and, more particularly, to improved guidance of flow through the discharge port of a screw compressor so as to reduce kinetic losses at the discharge port, thereby improving compressor efficiency.

Figure 1:
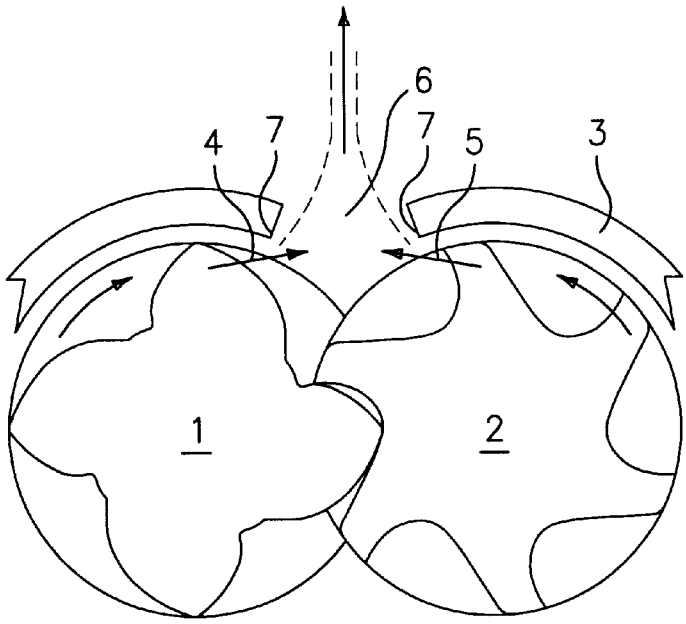
FIG. 1 (PRIOR ART)
FIG. 1 schematically illustrates a prior art compressor housing and porting structure and flow constriction caused thereby.

FIG. 1 illustrates a prior art configuration wherein rotors 1, 2 rotate within a housing, a portion of which is illustrated at 3, and generate streams 4, 5 of discharge flow which exit through a discharge port 6.

In accordance with conventional structures, sharp corners 7 are typically provided at discharge port 6, and such sharp corners 7 result in substantial contraction of flow in the discharge flow direction. This is undesirable, and can result in inefficient operation and/or the need for potentially bulky diffuser structures and the like.

Figure 2:
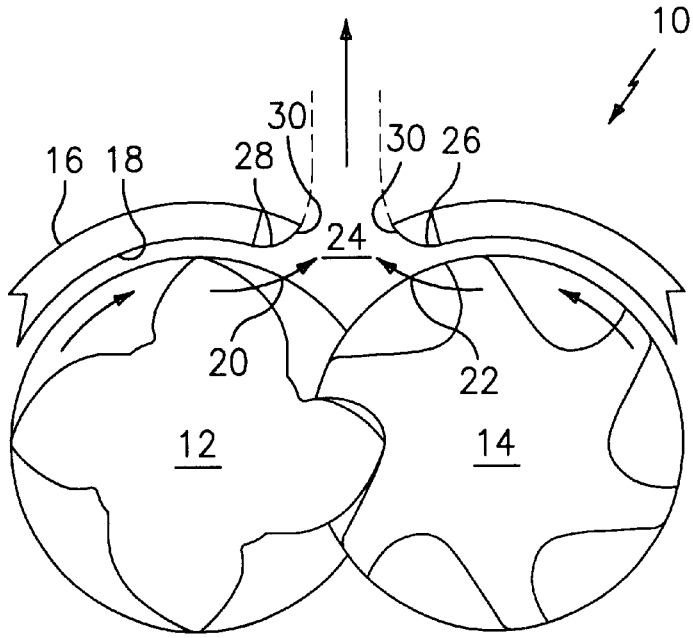
FIG. 2 schematically illustrates a screw compressor including flow guiding structure in accordance with the present invention.

Turning to FIG. 2, in accordance with the present invention, a solution to this problem is provided wherein screw compressor 10 has rotors 12, 14 rotatably mounted within a housing 16 having an inner surface 18 defining substantially cylindrical spaces within which rotors 12, 14 rotate.

As with the conventional compressor, rotors 12, 14 generate generally opposed discharge flows 20, 22 which in accordance with the present invention are advantageously guided through a discharge port 24 so as to reduce contraction of the flow through discharge port 24 as desired.

In accordance with the present invention, housing 16 has edges 26 which define discharge port 24, and the opening through which discharge flow occurs, and edges 26 are advantageously rounded so as to smooth flow of the discharge flows from rotors 12, 14, past edges 26. This advantageously reduces contraction of the flow downstream of discharge port 24, thereby resulting in a more efficient compressor operation.

It should be noted that point 7 of the prior configuration of FIG. 1 and point 28, the beginning of rounded edge 26 in accordance with the present invention and as illustrated in FIG. 2, are at approximately the same location, thus maintaining the design internal pressure ratio or volume index ($V_i$) of the compressor. It may be desirable, depending upon other compressor characteristics, to reduce the internal pressure ratio and thereby gain more efficiency, and this can be accomplished by positioning rounded edges 26, and point 28 of same wherein the port opens, at different locations.

Edges 26 in accordance with the present invention are preferably smooth transitioning curves from a first portion substantially aligned with or tangential to inner surface 18, through to a second portion 30 which is substantially aligned with or tangential to the direction of flow through discharge port 24. Rounded edges 26 advantageously smoothly curve or transition between the first portion 28 and second portion 30, as illustrated, so that flow from rotors 12, 14 is more gradually guided to the discharge flow direction, thereby resulting in reduced contraction of the flow as desired.

It should readily be appreciated that rounded edges 26 of discharge port 24 in accordance with the present invention advantageously serve to provide for reduced contraction or constriction of flow through discharge port 24, which advantageously provides for enhanced efficiency and operation of the compressor provided with such rounded edges. These rounded edges can be designed into newly manufactured compressors, and/or can be machined into existing structure for improvement in operation of existing equipment, as desired.

In further accordance with the invention, additional arcs or other flow-guiding structure can advantageously be provided which extend into the axial discharge area to re-direct tangential flow from the axial port to the axial and/or radial directions.

Figure 3:
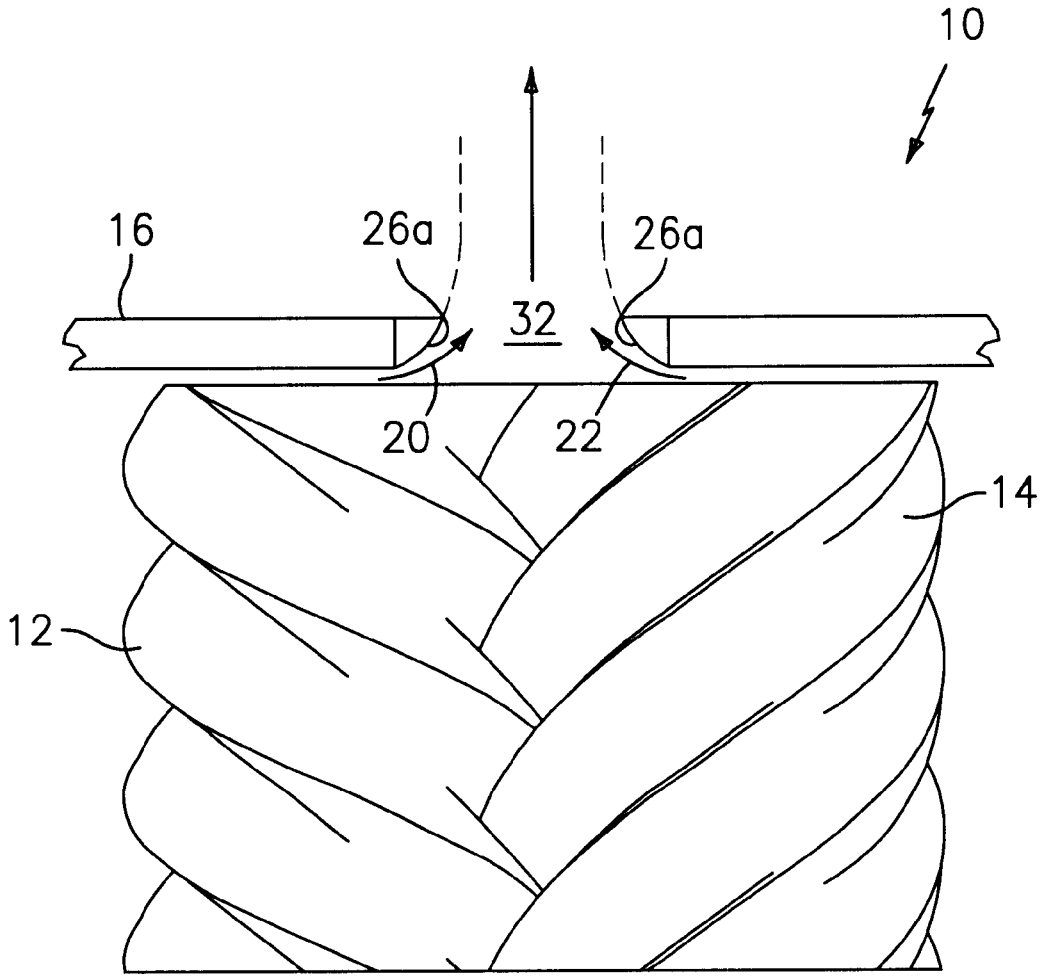
FIG. 3 schematically illustrates a screw compressor including flow-guiding structure in accordance with the present invention, and illustrates additional flow-guiding rounded surfaces or arcs extending into the axial discharge area.

FIG. 3 schematically illustrates a side view of a compressor in accordance with the present invention and illustrates flow into an axial discharge port of same.

FIG. 3 further illustrates an embodiment in accordance with the present invention wherein compressor 10 includes housing 16 having rounded edges 26*a* which define an axial discharge port 32. Rounded edges 26*a* are similar in structure to rounded edges 26 of FIG. 2, and preferably extend from a first portion or point substantially tangential to flow coming off of the axial edge of the rotors, and gradually transitions to a point or portion which is substantially tangential to flow entering axial discharge area 32.

The same rounding principle applies to axial discharge port 32. Thus, the embodiment illustrated in FIG. 3, including rounded edges 26*a*, would tend to reduce flow contraction losses at the discharge port, and both radial and axial discharge ports may advantageously be provided having rounded edges so as to maximize the benefits obtained in accordance with the present invention.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A screw compressor, comprising:

a housing having a discharge port; and at least two rotors disposed in said housing for generating opposed discharge flows through said discharge port, wherein said discharge port has edges defining a discharge opening, and wherein said edges are rounded so as to smooth flow of said discharge flows past said edges, wherein said housing has an inner surface defining substantially cylindrical spaces for rotatably receiving said rotors, and wherein said rounded edges are defined by edge surfaces extending from a portion tangential to said inner surface and curving to a portion substantially aligned with a direction of flow through said discharge port, whereby contraction of said flow through said discharge port is reduced.

2. The apparatus of claim 1, wherein said discharge port has an axial opening defined by axial edges and a radial opening defined by radial edges, and wherein said axial edges and said radial edges are rounded.

* * * * *